US005325550A

United States Patent [19]

Dearstyne et al.

[11] Patent Number: 5,325,550

[45] Date of Patent: Jul. 5, 1994

[54] APPARATUS FOR USE IN TRANSPORTING A DISABLED PERSON

[76] Inventors: Robert C. Dearstyne, 387 Willow Green Dr., Amherst, N.Y. 14228; Abir Mullick, 341 Parkside Ave., Buffalo, N.Y. 14150

[21] Appl. No.: 965,995

[22] Filed: Oct. 23, 1992

[51] Int. Cl.[5] ..... A61G 7/10

[52] U.S. Cl. ..... 5/89.1; 294/67.31

[58] Field of Search ..... 294/67.1, 67.2, 67.22, 294/67.3, 67.31, 106, 118, 140; 5/81.1-89.1; 119/96; 414/921

[56] References Cited

U.S. PATENT DOCUMENTS

| | | | |
|---|---|---|---|
| 1,876,832 | 9/1932 | Bancroft | 5/89.1 |
| 2,523,891 | 9/1950 | Wallstrom | 294/1140 X |
| 2,650,725 | 9/1953 | Hoyer et al. | 414/921 X |
| 3,234,568 | 2/1966 | Fischer | 5/89.1 |
| 3,469,269 | 9/1969 | Brown | 5/86.1 |
| 3,568,226 | 3/1971 | Mater et al. | 5/81.1 |
| 3,608,104 | 9/1971 | Van Gerven | 5/83.1 |
| 3,677,424 | 7/1972 | Anderson | 414/921 X |
| 4,125,908 | 11/1978 | Vail et al. | 5/83.1 |
| 4,221,011 | 9/1980 | Flinchbaugh | 5/89.1 |
| 4,509,785 | 4/1985 | Van Raemdonck et al. | 294/118 |
| 4,739,526 | 4/1988 | Hollick | 5/83.1 |
| 4,882,798 | 11/1989 | Worsnop | 294/67.31 X |
| 4,903,355 | 2/1990 | Hickerson | 5/83.1 |
| 4,944,056 | 7/1990 | Schroeder et al. | 5/81.1 |

FOREIGN PATENT DOCUMENTS

| | | | |
|---|---|---|---|
| 905306 | 12/1986 | Belgium . | |
| 1046202 | 1/1979 | Canada | 5/89.1 |
| 2287211 | 5/1976 | France | 5/89.1 |

OTHER PUBLICATIONS

Brochure describing product made by Handi-Move of Belgium, no date.

*Primary Examiner*—Johnny D. Cherry

*Attorney, Agent, or Firm*—Robert P. Simpson; Michael L. Dunn

[57] ABSTRACT

A carriage for a person which may be attached to a transporting device, comprising a frame, structure attached to the frame for holding the torso of the person in an essentially vertical position, and thigh retaining structure having first and second attachment members secured to the frame and operatively arranged such that when the thigh retaining structure is engaged, and the straps are properly secured, the thighs of the person are held in a substantially horizontal position.

2 Claims, 3 Drawing Sheets

APPARATUS FOR USE IN TRANSPORTING A DISABLED PERSON

BACKGROUND OF THE INVENTION

The present invention relates generally to the transporting of disabled persons, and, more particularly, to an improved carriage or harness for attachment to a disabled person to be transported by a hoist.

Transfer hoists for disabled persons are typically used by paraplegic, quadriplegic, handicapped, weak, or elderly persons for transport from one place to another, such as from a wheelchair to a bed, etc. Such hoists are well known in the art, and examples can be seen in the following U.S. patents: U.S. Pat. No. 4,944,056 (Schroeder et al.); U.S. Pat. No. 4,125,908 (Vail et al.); U.S. Pat. No. 3,677,424 (Anderson); and U.S. Pat. No. 2,650,725 (Hoyer et al.).

A critical element of every hoist system is the carriage or harness which is attached to the patient and also connected to the hoist. Despite the many advances made in hoist systems in general, including the many safety features as found, for example, in the Schroeder patent recited above, problems still exist in the art with respect to the carriage.

Ideally, the carriage should, above all, be safe. The patient must be prevented from falling out of the harness at all times during transport, including lifting, moving laterally, and descending. The carriage should have ample headroom, so that the patient cannot bump his head during transport. Also, the carriage should, as much as possible, distribute the lifting forces about the body, since excessive pressure in any one area can be uncomfortable if not injurious.

The ideal harness should be comfortable for the patient. In this respect, elements of the harness which are in contact with the body should be cushioned or padded. The harness should also be lightweight and inexpensive. It should also be of an extremely stable design, which is a real engineering challenge when one considers that the disabled person is suspended in air and is usually unable to assist in stabilizing himself.

Most early hoists used slings or straps to support the patient (e.g., Hoyer et al., supra). Straps, used alone, to support the legs and thorax of a patient can be extremely uncomfortable and even injurious. Straps can cause cutting or chaffing of a patient's skin, and, as demonstrated in FIG. 2 of U.S. Pat. No. 2,650,725, can place undue pressure on a patient's back. A further problem with the device disclosed in the above-recited patent to Hoyer et al. is that the patient can actually slip out of the harness between the thoracic and leg slings.

Further examples of sling designs can be found in U.S. Pat. No. 3,677,424 (Anderson) and U.S. Pat. No. 4,944,056 (Schroeder et al.).

An improvement over the sling design is disclosed in U.S. Pat. No. 4,509,785 (Van Raemdonck et al.) and an associated product manufactured by Handi-Move of Belgium. The Handi-Move device uses a "scissor-arm" frame design with extensions which support the patient under his arms. The device does not use any slings, but does use leg supports which slide under the thigh to create and support a sitting position. A problem with the Handi-Move design is that it creates excessive pressure under the patient's arms, and does not distribute the forces associated with lifting. A second problem is that, when the patient is lowered, and as the legs come in contact with a bed or other surface, the leg supports tend to become disengaged which de-stabilizes the device, which can allow the patient to fall out of the back of the apparatus.

Thus, there is a need for an improved carriage or harness for transporting a disabled person which distributes the forces associated with lifting over a greater surface area of the person and does not exert most of the force under the person's arms, thereby making the device more comfortable to use, and which also includes leg supports which do not easily disengage when the person is lowered into contact with a bed or other surface.

SUMMARY OF THE INVENTION

The invention comprises a carriage for a person which may be attached to a transporting means. In general the carriage comprises:

a) a frame b) means attached to the frame for holding the torso of the person in an essentially vertical position; and c) a thigh retaining means.

The thigh retaining means comprises first and second strap attachment means secured to the frame. The first attachment means is positioned above a first thigh of the person when the thigh retaining means is engaged and the second strap attachment means is positioned above a second thigh of the person when the thigh retaining means is engaged. A first strap is attached to the first strap attachment means, and when the thigh retaining means is engaged, the first strap passes under said first thigh and up to and attached to the second strap attachment means. A second strap is attached to the second strap attachment means, and when the thigh retaining means is engaged, passes under the second thigh and up to and is attached to the first strap attachment means. When the straps are so attached, the thighs of the person are held in a substantially horizontal position.

The carriage desirably further comprises the embodiment wherein the frame comprises two legs, each of the legs being provided with an essentially vertical central portion, an inwardly directed top portion and a horizontal lower portion. The legs are hinged together by a hinge proximate the ends of their top portions. The lower portions are provided with concave arcs relative to each other such that an approximate ellipse is defined by the arcs. The arcs are padded and sized to engage the upper torso of the person about the sides of the person's chest below the arms, when the thigh retaining means is engaged. The hinge permits the lower portions of the legs to be moved away from each other to permit the arcs to be easily positioned about the chest of the person and to permit the legs to be easily moved toward each other to permit the arcs to engage sides of the chest of the person when the carriage is in use. The hinge is further provided with a means to permit attachment to the transporting means.

The carriage permits secure engagement with a person to be carried, without significant stress under the person's arms. The thigh retaining means is stable and will not readily disengage at inappropriate times. Nor can the person readily fall backward from the carriage as the feet or legs of the person touch the floor due to the secure engagement of both the thigh retaining means with the thighs and the frame arcs with the sides of the chest. Lifting weight is more evenly distributed over larger body areas than has been possible with prior carriages.

DETAILED DESCRIPTION OF THE INVENTION

The invention may be readily described with reference to the drawings which illustrate a preferred embodiment of the invention. It is to be understood that the embodiment is for purposes of illustration and modifications may be envisioned while remaining within the scope of the invention.

Figure 1:
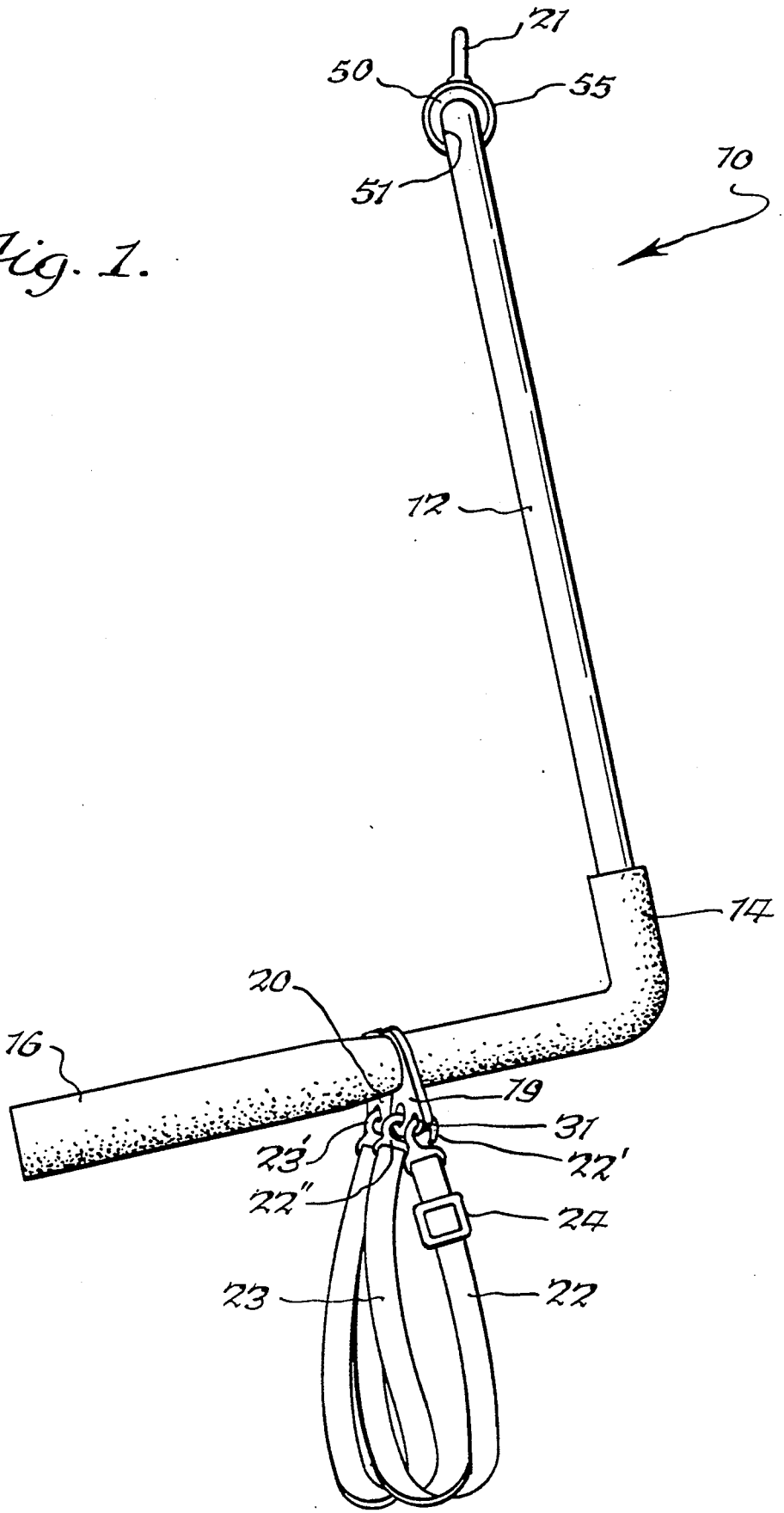
FIG. 1 is a side view of the carriage of the invention.
Figure 2:
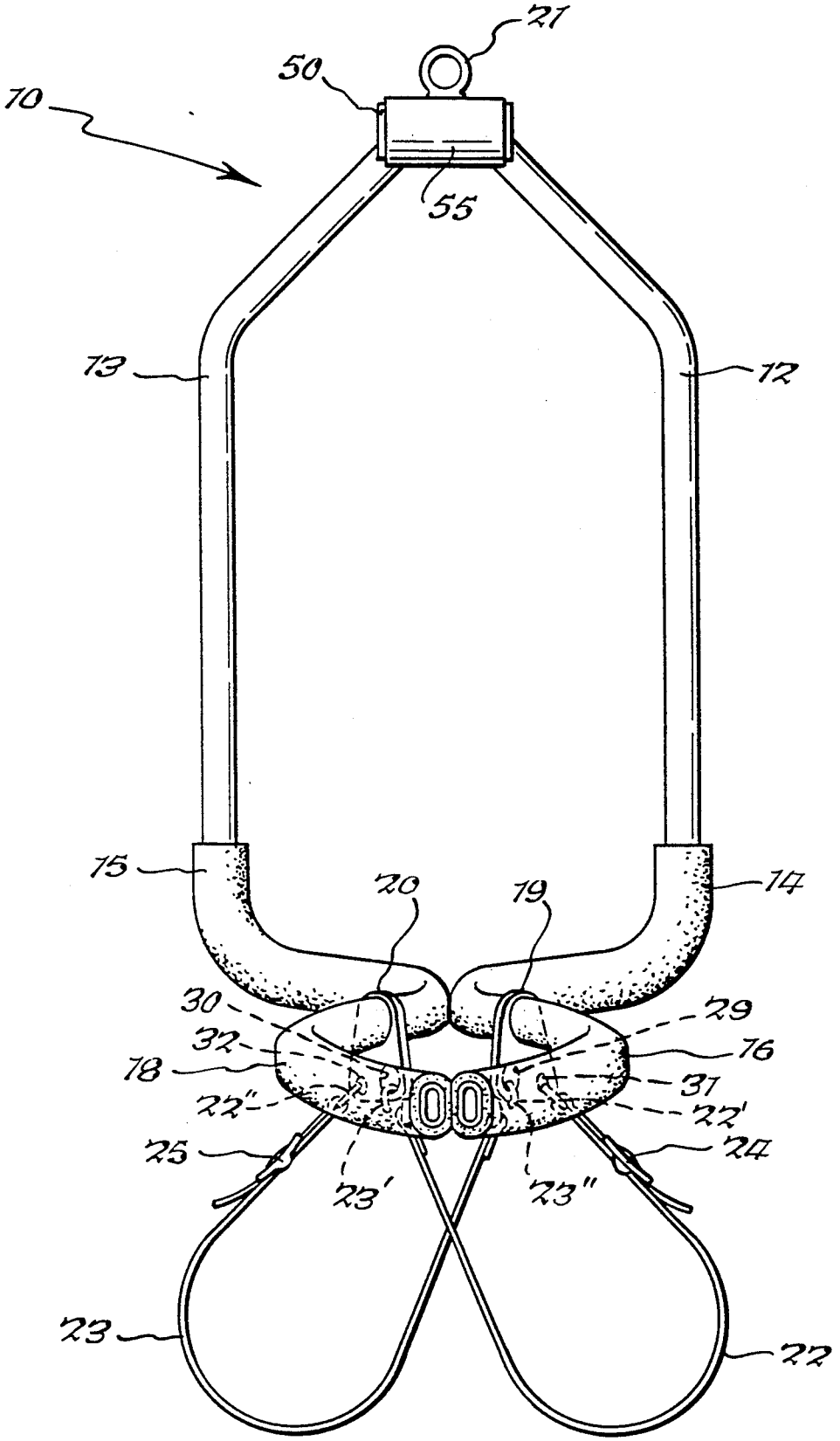
FIG. 2 is a front view of the carriage of the invention.
Figure 3:
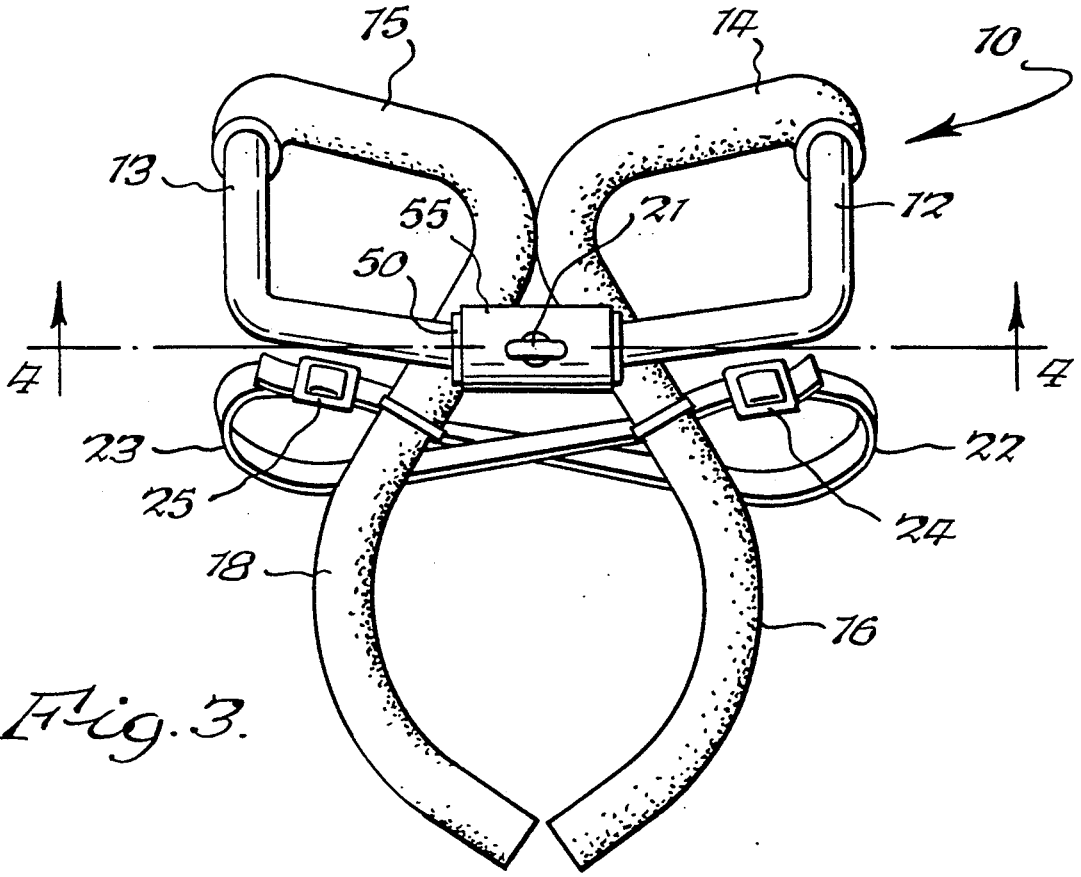
FIG. 3 is a top view of the carriage of the invention.
Figure 4:
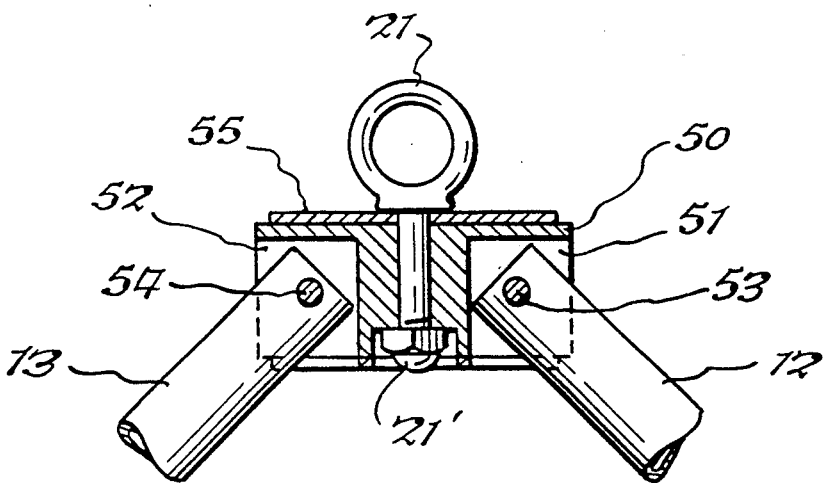
FIG. 4 is a cross sectional view of the hinge of the carriage of the invention.

As can be seen by reference to the drawings, especially FIG. 1, the carriage 10 of the invention comprises two frame members 12 and 13 connected at their inwardly directed top portions to hinge 55 by means of pins 53 and 54. The top portions fit within spaces 51 and 52 of the hinge. An eye bolt 21 serving as an attachment means for the carriage 10 passes through the solid portion 50 of the hinge and is secured by nut 21'. The vertical central portions of legs 12 and 13 connect the top portions of the legs with horizontal lower portions 16 and 18 which are in the form of concave arcs relative to each other for engagement with the sides of the chest of a person to be carried. The areas on the lower portions are covered with soft flexible tubes 14 and 15 for the comfort of the person being carried.

The thigh retaining means comprises first and second strap attachment means 19 and 20 which are secured to horizontal portions 16 and 18 of the legs 12 and 13 which together with the hinge 55 constitute the frame. A first strap 22 is secured at a first end to a first strap attachment means 19 at hole 31 by means of eye 22' and is attached at its other end to second strap attachment means 20 at hole 30 by means of hook 23'. Similarly, second strap 23 is secured at a first end to second strap attachment means 20 at hole 32 by means of eye 22'' and is attached at its other end to first strap attachment means 19 at hole 29 by means of hook 23''. The straps are adjustable for persons of different size by means of buckles 24 and 25.

As can best be envisioned by reference to FIG. 1, the thighs of the person to be carried fit within the loops formed by straps 22 and 23. It is clear from the drawings that legs 12 and 13 may be rotated in hinge 55 to move arcs 16 and 18 apart, thus giving easy access to the carrier and that the weight of the person being carried will again move the legs together for secure engagement with the person.

What is claimed is:

1. A carriage for a person which may be attached to a transporting means, said carriage comprising:

a ) a frame;

b) means attached to the frame for holding the torso of the person in an essentially vertical position; and c) a thigh retaining means, said thigh retaining means comprising first and second strap attachment means secured to the frame, said first attachment means being positioned above a first thigh of the person when the thigh retaining means is engaged and said second strap attachment means being positioned above a second thigh of the person when the thigh retaining means is engaged, a first strap attached to said first strap attachment means, and when the thigh retaining means is engaged, passing under said first thigh and up to and attached to the second strap attachment means, and a second strap attached to the second strap attachment means, and when the thigh retaining means is engaged, passing under said second thigh and up to and attached to the first strap attachment means, so that when the straps are so attached, the thighs of the person are held in a substantially horizontal position.

2. A carriage for a person which may be attached to a transporting means, said carriage comprising:

a) a frame;

b) means attached to the frame for holding the torso of the person in an essentially vertical position;

c) a thigh retaining means, said thigh retaining means comprising first and second strap attachment means secured to the frame, said first attachment means being positioned above a first thigh of the person when the thigh retaining means is engaged and said second strap attachment means being positioned above a second thigh of the person when the thigh retaining means is engaged, a first strap attached to said first strap attachment means, and, when the thigh retaining means is engaged, passing under said first thigh and up to and attached to the second strap attachment means, and a second strap attached to the second strap attachment means, and, when the thigh retaining means is engaged, passing under said second thigh and up to and attached to the first strap attachment means, so that when the straps are so attached, the thighs of the person are held in a substantially horizontal position;

wherein the frame comprises two legs, each of said legs being provided with an essentially vertical central portion, an inwardly directed top portion and a horizontal lower portion, said legs being hinged together by a hinge proximate ends of their top portions, said lower portions being provided with concave arcs relative to each other such that an approximate ellipse is defined by said arcs, said arcs being padded and sized to engage the upper torso of said person about the sides of the person's chest below the arms, when the thigh retaining means is engaged, said hinge permitting the lower portions of the legs to be moved away from each other to permit the arcs to be easily positioned about the chest of the person and to permit the legs to be easily moved toward each other to permit the arcs to engage sides of the chest of the person when the carriage is in use, said hinge being further provided with a means to permit attachment to the transporting means.

* * * * *